US008926386B2

(12) United States Patent
Berenson

(10) Patent No.: US 8,926,386 B2
(45) Date of Patent: Jan. 6, 2015

(54) FLOTATION DEVICE FOR IMPROVED SAFETY

(75) Inventor: Steven M. Berenson, Canton, MA (US)

(73) Assignee: Aqua-Leisure Industries, Inc., Avon, MA (US)

( * ) Notice: Subject to any disclaimer, the term of this patent is extended or adjusted under 35 U.S.C. 154(b) by 281 days.

(21) Appl. No.: 13/483,195

(22) Filed: May 30, 2012

(65) Prior Publication Data

US 2013/0323991 A1 Dec. 5, 2013

(51) Int. Cl.
*B63C 9/08* (2006.01)

(52) U.S. Cl.
USPC ..... 441/108

(58) Field of Classification Search
CPC ..... B63C 9/08; B63C 9/081; B63C 9/082; B63C 9/087; B63C 9/105; B63C 9/1055; B63C 9/11; B63C 9/125; B63C 9/1255; B63C 9/13; B63C 9/15; B63C 9/155; B63C 9/18
USPC ..... 441/80, 87, 88, 90, 102, 106, 108, 441/120–123, 129–131
See application file for complete search history.

(56) References Cited

U.S. PATENT DOCUMENTS 2,292,490 A * 8/1942 Stokes ..... 441/109
5,454,744 A * 10/1995 Seiler ..... 441/109

* cited by examiner

*Primary Examiner* — Daniel V Venne
(74) *Attorney, Agent, or Firm* — Lando & Anastasi, LLP

(57) ABSTRACT

According to one aspect, embodiments of the invention provide a construction for a flotation device, the construction comprising a pants portion configured to be worn on the lower body of a user, and an inflatable core coupled to the pants portion and configured to encircle the midsection of the user, wherein the inflatable core includes a first chamber and a second chamber, each chamber configured to encircle the midsection of the user and to be separately inflatable.

18 Claims, 5 Drawing Sheets

FLOTATION DEVICE FOR IMPROVED SAFETY

BACKGROUND OF THE DISCLOSURE

1. Field of the Invention

At least one example in accordance with the present invention relates generally to floating pool and beach toys for babies and toddlers.

2. Discussion of Related Art

Flotation devices are commonly utilized to keep a young child, such as a baby or toddler, floating at the surface of a body of water while preventing the child from becoming submerged in the water. For example, flotation devices such as inflatable bubbles, foam bubbles, life preservers and inflatable arm bands are oftentimes attached to a child to keep the child afloat while the child is in the water. In addition, young children are often placed inside flotation devices such as inflatable boats to keep the child above water.

SUMMARY

Aspects in accord with the present invention are directed to a construction for a flotation device, the construction comprising a pants portion configured to be worn on the lower body of a user, and an inflatable core coupled to the pants portion and configured to encircle the midsection of the user, wherein the inflatable core includes a first chamber and a second chamber, each chamber configured to encircle the midsection of the user and to be separately inflatable.

According to one embodiment, the construction further comprises a shirt portion configured to be worn on the upper body of the user and also coupled to the inflatable core. In one embodiment, at least one of the pants portion and the shirt portion is made of stretchable fabric. In another embodiment, at least one of the pants portion and the shirt portion includes soft non-chaffing trim.

According to another embodiment, the inflatable core is made of rubber. In one embodiment, the first chamber is an exterior chamber and the second chamber is an interior chamber, and wherein the interior chamber is coupled to an interior side of the exterior chamber. In another embodiment, the exterior chamber has a larger diameter than the interior chamber.

According to one embodiment, the construction further comprises a floatable safety ring and wherein the inflatable core is configured to be inserted into the floatable safety ring. In one embodiment, the floatable safety ring comprises a ring portion, a well located within the ring portion, and at least one aperture located in the well, wherein the inflatable core is configured to be inserted into the well, and wherein the at least one aperture is configured to encircle the pants portion.

According to one embodiment, the well includes a bottom surface and wherein the inflatable core is configured to rest on the bottom surface of the well upon being inserted into the well. In one embodiment, the bottom surface includes at least one grip pad for securing the bottom surface to the inflatable core.

Another aspect in accord with the present invention is directed to a construction for a flotation device, the construction comprising a pants portion configured to be worn on the lower body of a user, an inflatable core coupled to the pants portion and configured to encircle the midsection of the user, and a safety ring, wherein the inflatable core includes a first chamber and a second chamber, each chamber configured to encircle the midsection of the user and to be separately inflatable, and wherein the inflatable core is configured to be inserted into the safety ring.

According to one embodiment, the construction further comprises a shirt portion configured to be worn on the upper body of the user and also coupled to the inflatable core. In one embodiment, at least one of the pants portion and the shirt portion is made of stretchable fabric. In another embodiment, the inflatable core is made of rubber.

According to another embodiment, the first chamber is an exterior chamber and the second chamber is an interior chamber, and wherein the interior chamber is coupled to an interior side of the exterior chamber. In one embodiment, the exterior chamber has a larger diameter than the interior chamber.

According to one embodiment, the safety ring comprises a ring portion, a well located within the ring portion, and at least one aperture located in the well, wherein the inflatable core is configured to be inserted into the well, and wherein the at least one aperture is configured to encircle the pants portion. In one embodiment, the well includes a bottom portion and wherein the inflatable core is configured to rest on the bottom portion upon being inserted into the well. In another embodiment, the bottom portion includes at least one grip pad for securing the bottom portion to the inflatable core.

BRIEF DESCRIPTION OF DRAWINGS

The accompanying drawings are not intended to be drawn to scale. In the drawings, each identical or nearly identical component that is illustrated in various FIGs. is represented by a like numeral. For purposes of clarity, not every component may be labeled in every drawing. In the drawings.

DETAILED DESCRIPTION OF THE PREFERRED EMBODIMENTS

Figure 1C:
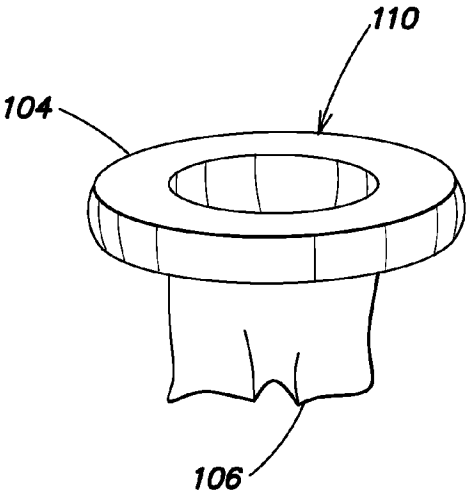
FIG. 1C illustrates a safety seat in accordance with aspects of the present invention.

For the purposes of illustration only, and not to limit the generality, the present disclosure will now be described in detail with reference to the accompanying figures. This disclosure is not limited in its application to the details of construction and the arrangement of components set forth in the following description or illustrated in the drawings. The disclosure is capable of other embodiments and of being practiced or being carried out in various ways. Also the phraseology and terminology used herein is for the purpose of description and should not be regarded as limiting. The use of "including," "comprising," "having," "containing," "involving," and variations thereof herein, is meant to encompass the items listed thereafter and equivalents thereof as well as additional items.

As described above, flotation devices are oftentimes utilized to keep a young child, such as a baby or toddler, floating at the surface of a body of water while preventing the child from becoming submerged in the water. However, conventional flotation devices may have buoyancy, stability and/or safety problems. For example, typical flotation devices may not fit securely onto a child and as a result may inadvertently become detached from the child or become situated so as not to adequately keep a child's head from becoming submerged in the water.

As such, embodiments of the current invention provide a flotation device with enhanced safety, stability, comfort and buoyancy.

Figure 1B:
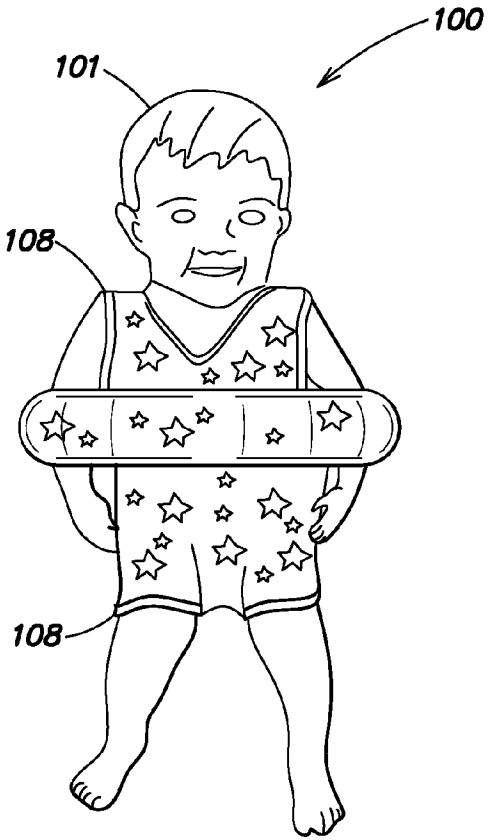
FIG. 1B illustrates a safety trainer being used by a young child in accordance with aspects of the present invention.
Figure 1A:
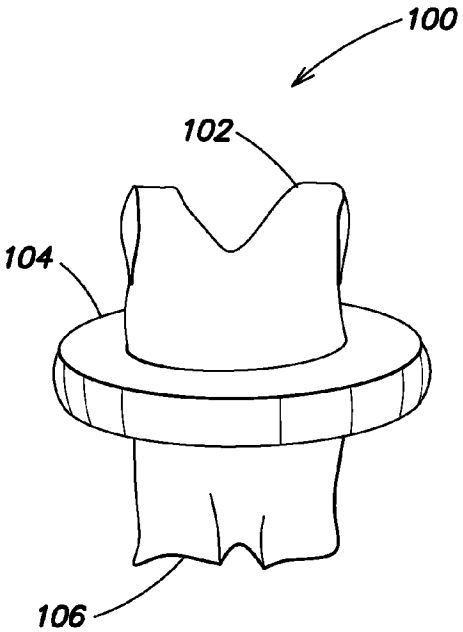
FIG. 1A is illustrates a safety trainer in accordance with aspects of the present invention.

FIGS. 1A and 1B illustrate a safety trainer 100 in accordance with aspects of the present invention. The safety trainer 100 includes a shirt portion 102 coupled to an inflatable core 104 and a pants portion 106. According to one embodiment, the shirt portion 102 and/or the pants portion 106 is made of stretchable fabric to provide a comfortable fit for a child wearing the safety trainer 100. According to another embodiment, the shirt portion 102 and/or the pants portion 106 includes soft non-chafing trim 108 to provide added comfort for a child wearing the safety trainer.

FIG. 1B illustrates the safety trainer 100 being worn by a young child 101. The shirt portion 102 covers part of the upper body of the child 101 and the pants portion 106 covers part of the lower body of the child 101. The inflatable core 104 is configured to encircle the midsection of the child 101. By coupling the inflatable core 104 to both the shirt portion 102 and the pants portion 106, the location of the inflatable core 104 is maintained at the midsection of the child 101 (e.g., the inflatable core 104 may not become unstable and move up onto the upper body or down onto the lower body of the child 101). In this way, the safety trainer 100 is more stable and will maintain the child in an upright position, floating with his/her head above water. According to one embodiment, the inflatable core 104 is made of rubber; however, in other embodiments, the inflatable core 104 may be made of any suitable rugged material.

According to one embodiment, a safety seat 110 (as seen in FIG. 1C) may comprise only the inflatable core 104 coupled to the pants portion 106. While being worn by a child, the location of the inflatable core 104 may still be maintained at the midsection of the child by the pants portion 106. For example, by coupling the inflatable core 104 to the pants portion 106, the pants portion 106 will prevent the inflatable core 104 from riding up onto the upper body of the child (e.g., up under the child's arms), hence providing a safer and more stable safety trainer 110. According to another embodiment, a safety trainer may include only the inflatable core 104 coupled to the shirt portion 102.

Figure 2A:
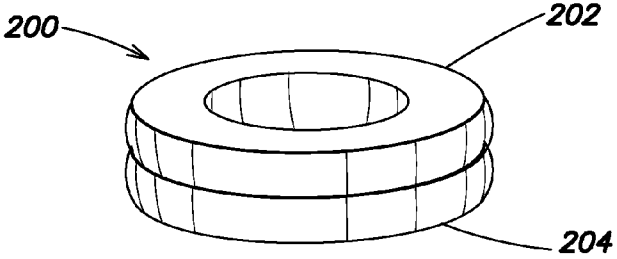
FIG. 2A illustrates a twin chamber inflatable core in accordance with aspects of the present invention.

According to one embodiment, the inflatable core 104 is a twin chamber inflatable core. For example, as shown in FIG. 2A, the inflatable core 200 may include two separate chambers 202, 204. In one embodiment, the two separate chambers include an upper chamber 202 and a lower chamber 204. According to one embodiment, each of the chambers 202, 204 includes a separate valve (not shown), so that each chamber may be inflated and/or deflated independently. In this way, the twin chambers 202, 204 of the inflatable core 200 may be configured to provide an optimal fit for a child encircled by the core 200.

In other embodiments, the inflatable core 200 may include any number of chambers configured in any appropriate way. For example, according to another embodiment, the inflatable core 200 includes an interior chamber and an exterior chamber. For instance, as shown in the safety trainer 201 of FIG. 2B, the shirt portion 102 and the pants portion 106 may be coupled to an inflatable core having an exterior chamber 206 and an interior chamber 208.

According to one embodiment, the exterior chamber 206 encircles a child wearing the safety trainer 201. In one embodiment, the interior chamber 208 also encircles the child, with a diameter slightly smaller than the exterior chamber 206, so that the interior chamber 208 fits between the exterior chamber 206 and the child wearing the safety trainer, around an interior side of the exterior chamber 206. According to one embodiment, each chamber 206, 208 includes a separate valve (not shown), so that each chamber may be inflated and/or deflated independently. In this way, the twin chambers 206, 208 may be configured to provide an optimal fit for a child encircled by the two chambers 206, 208.

Figure 2C:
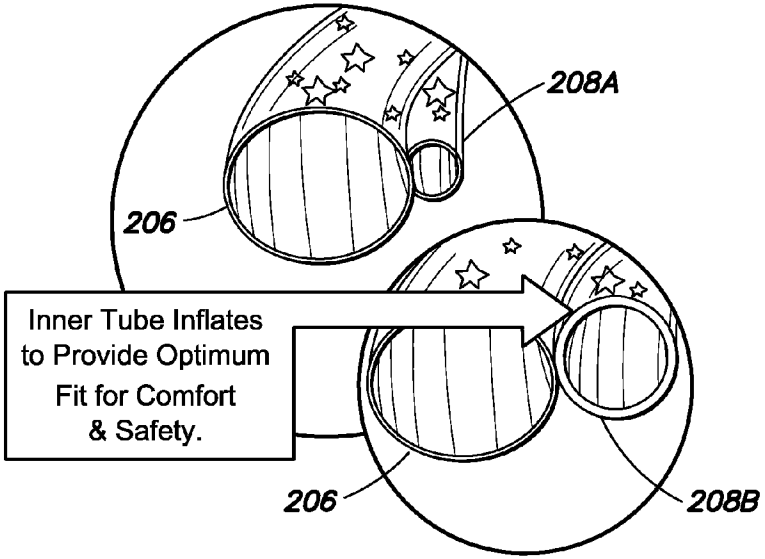
FIG. 2C is a cross sectional diagram of a twin chamber inflatable core in accordance with aspects of the present invention.
Figure 2B:
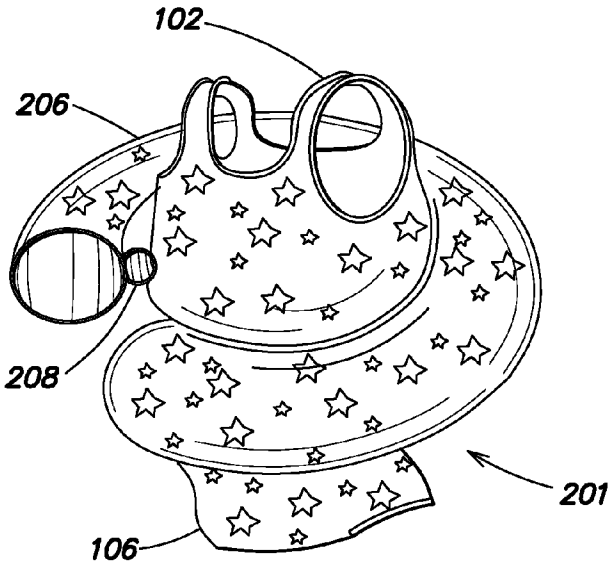
FIG. 2B is a cut away diagram of a twin chamber inflatable core in accordance with aspects of the present invention.

For example, according to one embodiment, and as seen in FIG. 2C, the interior chamber 208 may be inflated from a first size 208A to a second size 208B, in order to provide a secure fit, specific to the child currently wearing the safety trainer 201. By inflating the interior chamber 208, the inflatable core will fit more tightly against the midsection of the child and will be prevented from sliding up onto the upper body or down onto the lower body of the child, creating a more stable safety trainer 201.

Figure 3C:
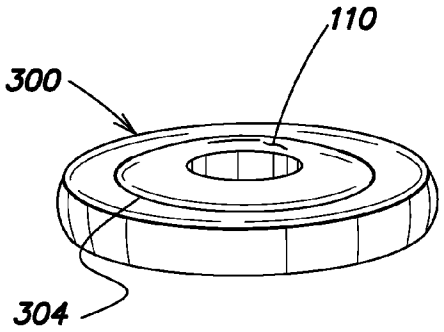
FIG. 3C illustrates a safety seat combined with a safety ring in accordance with aspects of the present invention.

According to one embodiment, in order to provide even greater stability, safety and buoyancy, the safety trainer may be configured to be inserted into a safety ring. For example, FIG. 3A illustrates a safety ring 300 in accordance with aspects of the present invention. The safety ring 300 includes a ring portion 302, a well 304 located within the ring portion 302 and at least one aperture 306 located within the well 304.

Figure 3B:
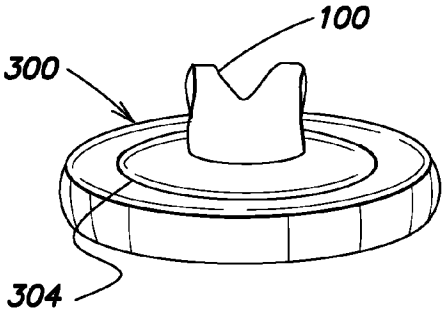
FIG. 3B illustrates a safety trainer combined with a safety ring in accordance with aspects of the present invention.
Figure 3A:
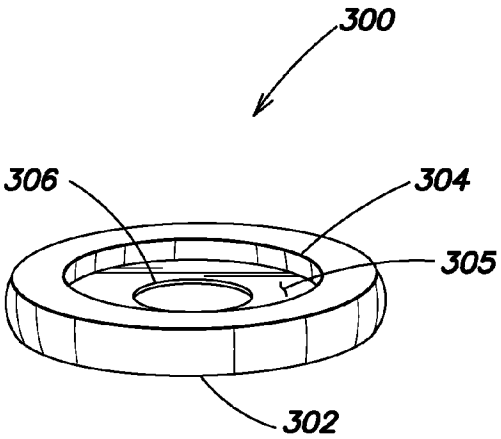
FIG. 3A illustrates a safety ring in accordance with aspects of the present invention.

According to one embodiment, as seen in FIG. 3B, the safety trainer 100 (as seen in FIGS. 1A and 1B) may be inserted into the well 304 of the safety ring 300. When the safety trainer 100 is inserted into the well 304, the legs (not shown) of a child wearing the safety trainer 100 and the pants portion 106 are inserted through the aperture 306 (i.e., into the water). The inflatable core 104 rests on a bottom surface 305 of the well 304 and hence, the well 304 supports the weight of the safety trainer 100. In this way, the safety trainer 100 sits flush against the bottom of the well 304, providing the safety trainer 100 with a larger base to float on top of the water. As a result, the stability, safety and buoyancy of the safety trainer 100 may be enhanced.

According to another embodiment, as seen in FIG. 3C, the safety seat 110 (as seen in FIG. 1C) may be inserted into the well 304 of the safety ring 300. When the safety seat 110 is inserted into the well 304, the legs (not shown) of a child wearing the safety seat 110 and the pants portion 106 are inserted into the aperture 306. The inflatable core 104 rests on a bottom surface 305 of the well 304 and hence, the well 304 supports the weight of the safety seat 110. In this way, the safety seat 110 sits flush against the bottom of the well 304, providing the safety seat 110 with a larger base to float on top of the water. As a result, the stability, safety and buoyancy of the safety seat 110 may be enhanced.

Figure 4:
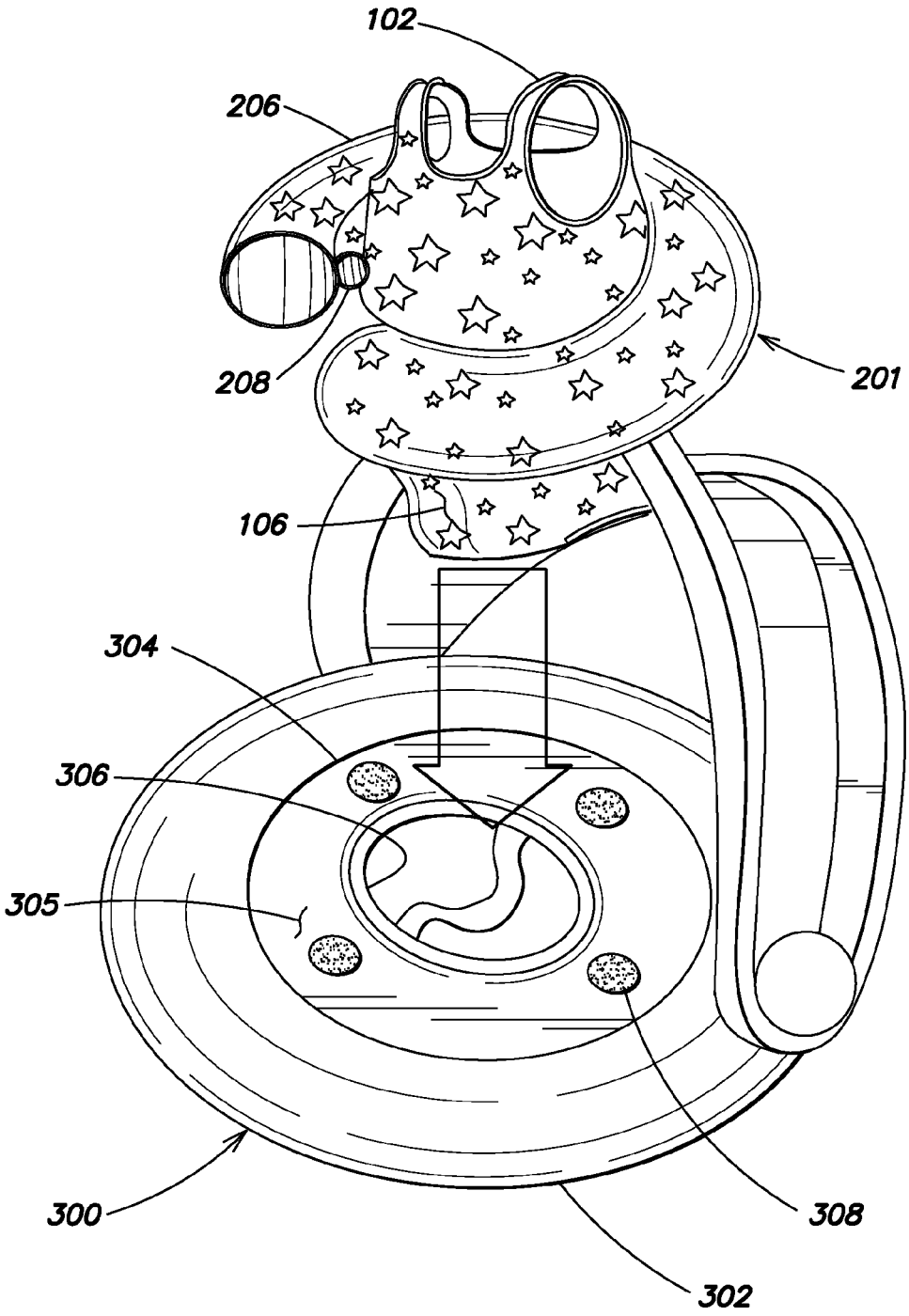
FIG. 4 illustrates a more detailed view of a safety trainer being combined with a safety ring in accordance with aspects of the present invention.

FIG. 4 illustrates a more detailed view of the safety trainer 201 being combined with a safety ring 300 in accordance with aspects of the present invention. As discussed above, the safety trainer 201 may include a shirt portion 102 and a pants portion 106, each coupled to an inflatable core having an exterior chamber 206 and an interior chamber 208. According to one embodiment, the exterior chamber 206 encircles a child wearing the safety trainer 201. In one embodiment, the interior chamber 208 also encircles the child, with a diameter slightly smaller than the exterior chamber 206, so that the interior chamber 208 fits between the exterior chamber 206 and the child wearing the safety trainer. According to one embodiment, each chamber 206, 208 includes a separate valve (not shown), so that each chamber may be inflated and/or deflated independently. In this way, the twin chambers 206, 208 may be configured to provide an optimal fit for a child encircled by the two chambers 206, 208.

According to one embodiment, as discussed above, the safety ring 300 includes a ring portion 302, a well 304 located within the ring portion 302 and at least one aperture 306 located within the well 304. As illustrated in FIG. 4, the safety ring 400 includes a single aperture 306; however, in other embodiments, the safety ring 400 may include more than one aperture 306. According to one embodiment, the safety ring also includes at least one grip pad 308. In one embodiment, the grip pads 308 are configured to rest against the exterior chamber 206, when the safety trainer 201 is fit into the safety ring 300, create friction between the grip pads 308 and the exterior chamber 206 and hold the safety trainer 201 in place. According to another embodiment, at least one grip pad 308 may include a first portion of a hook and loop fastener which is configured to be coupled to a second portion of the hook and loop fastener located on the exterior chamber 206.

According to one embodiment, as similarly discussed above, the safety trainer 201 may be inserted into the well 304 of the safety ring 300. When the safety trainer 201 is inserted into the well 304, the legs (not shown) of a child wearing the safety trainer 201 and the pants portion 106 are inserted into the aperture 306. The inflatable core 104 rests on a bottom surface 305 of the well 304 and hence, the well 304 supports the weight of the safety trainer 201. In this way, the safety trainer 201 sits flush against the bottom 305 of the well 304, providing the safety trainer 100 with a larger base to float on top of the water. As a result, the stability, safety and buoyancy of the safety trainer 201 may be enhanced.

Figure 5:
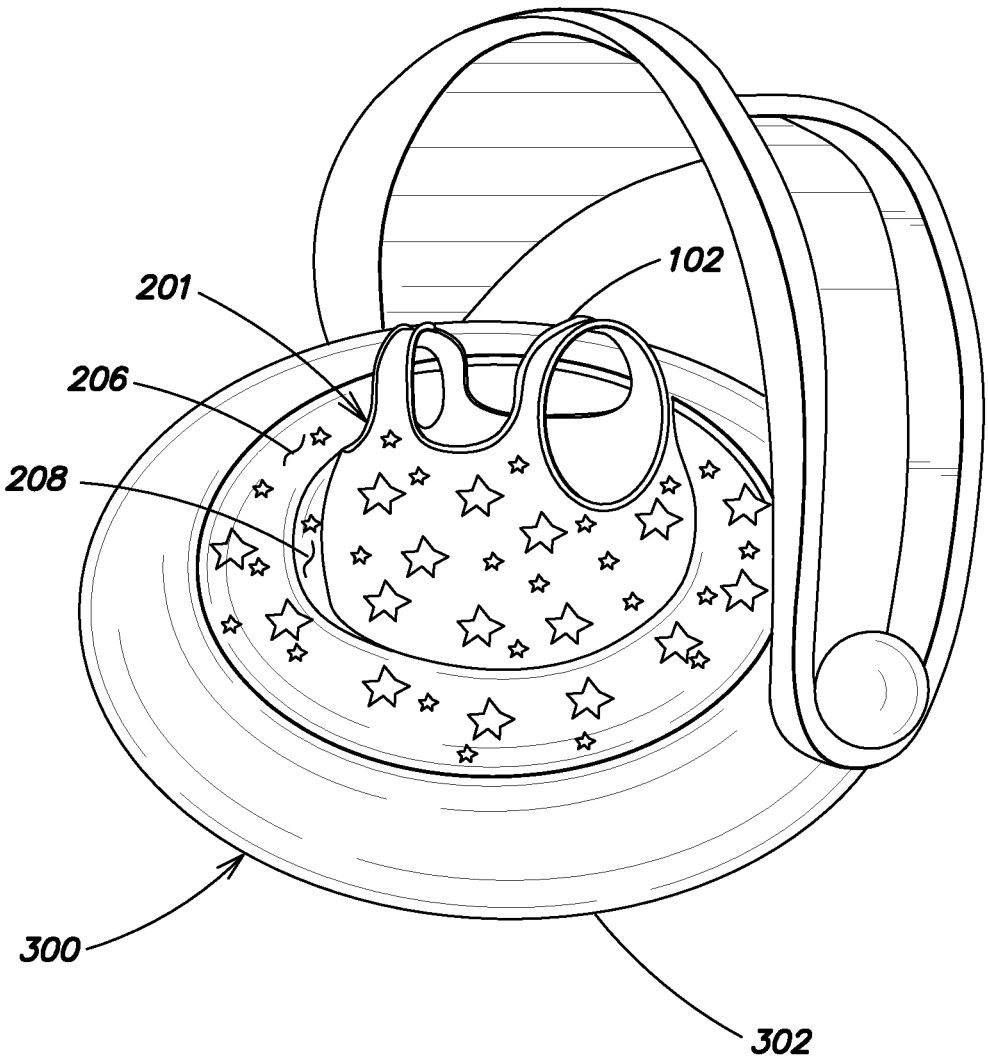
FIG. 5 illustrates a combined safety trainer and safety ring combination in accordance with aspects of the present invention.

FIG. 5 illustrates a combined safety trainer 201 and safety ring 300 in accordance with aspects of the present invention. As discussed above, after inserting the safety trainer 201 into the well 304, the safety trainer 201 sits flush against the bottom 305 of the well 304, providing the safety trainer 100 with a larger base to float on top of the water. As a result, the stability, safety and buoyancy of the safety trainer 201 may be enhanced.

According to one embodiment, elements of a floating pool and beach toy as described herein may be constructed of plastic material. For example, in one embodiment, the plastic material is Polyvinyl Chloride (PVC), reinforced PVC, PVC mesh, laminated PVC or any other plastic material. In one embodiment, the plastic material is transparent. In another embodiment, the plastic material includes decorative ornamentation.

Having thus described at least one embodiment of the present disclosure, various alternations, modifications and improvements will readily occur to those skilled in the art. Such alterations, modifications and improvements are intended to be within the scope and spirit of the disclosure. Accordingly, the foregoing description is by way of example only and is not intended to be limiting. The disclosure's limit is defined only in the following claims and equivalents thereto.

What is claimed is:

1. A flotation device comprising:

a floatable safety ring;

a pants portion configured to be worn on a lower body of a user; and an inflatable core coupled to the pants portion and configured to encircle a midsection of the user and to be inserted within the floatable safety ring, wherein the inflatable core includes a first chamber and a second chamber, each chamber configured to encircle the midsection of the user and to be separately inflatable, wherein the floatable safety ring comprises:

a ring portion;

a well located within the ring portion; and at least one aperture located in the well, wherein the inflatable core is configured to be inserted into the well, and wherein the at least one aperture is configured to encircle the pants portion.

2. The flotation device of claim 1, further comprising a shirt portion configured to be worn on the upper body of the user and also coupled to the inflatable core.

3. The flotation device of claim 2, wherein at least one of the pants portion and the shirt portion is made of stretchable fabric.

4. The flotation device of claim 2, wherein at least one of the pants portion and the shirt portion includes soft non-chaffing trim.

5. The flotation device of claim 1, wherein the inflatable core is made of rubber.

6. The flotation device of claim 1, wherein the first chamber is an exterior chamber and the second chamber is an interior chamber, and wherein the interior chamber is coupled to an interior side of the exterior chamber.

7. The flotation device of claim 6, wherein the exterior chamber has a larger diameter than the interior chamber.

8. The flotation device of claim 1, wherein the well includes a bottom surface and wherein the inflatable core is configured to rest on the bottom surface of the well upon being inserted into the well.

9. The flotation device of claim 8, wherein the bottom surface includes at least one grip pad for securing the bottom surface to the inflatable core.

10. A flotation device comprising:

a pants portion configured to be worn on a lower body of a user;

an inflatable core coupled to the pants portion and configured to encircle a midsection of the user; and a safety ring comprising:

a ring portion; and a well located within the ring portion;

wherein the inflatable core includes a first chamber and a second chamber, each chamber configured to encircle the midsection of the user and to be separately inflatable, and wherein the inflatable core is configured to be inserted into the well.

11. The flotation device of claim 10, further comprising a shirt portion configured to be worn on the upper body of the user and also coupled to the inflatable core.

12. The flotation device of claim 11, wherein at least one of the pants portion and the shirt portion is made of stretchable fabric.

13. The flotation device of claim 10, wherein the inflatable core is made of rubber.

14. The flotation device of claim 10, wherein the first chamber is an exterior chamber and the second chamber is an interior chamber, and wherein the interior chamber is coupled to an interior side of the exterior chamber.

15. The flotation device of claim 14, wherein the exterior chamber has a larger diameter than the interior chamber.

16. The construction of claim 10, wherein the safety ring further comprises:

at least one aperture located in the well, wherein the at least one aperture is configured to encircle the pants portion.

17. The flotation device of claim 10, wherein the well includes a bottom portion and wherein the inflatable core is configured to rest on the bottom portion upon being inserted into the well.

18. The flotation device of claim 17, wherein the bottom portion includes at least one grip pad for securing the bottom portion to the inflatable core.

* * * * *

UNITED STATES PATENT AND TRADEMARK OFFICE

CERTIFICATE OF CORRECTION

PATENT NO. : 8,926,386 B2
APPLICATION NO. : 13/483195
DATED : January 6, 2015
INVENTOR(S) : Steven M. Berenson It is certified that error appears in the above-identified patent and that said Letters Patent is hereby corrected as shown below:

In the Specification

Column 5, line 19, delete number "400" and insert --300--;

Column 5, line 20, delete number "400" and insert --300--.

Signed and Sealed this
Fourteenth Day of April, 2015

Michelle K. Lee

Michelle K. Lee
*Director of the United States Patent and Trademark Office*